United States Patent [19]

Kodama

[11] 4,368,699

[45] Jan. 18, 1983

[54] SELF-CONTAINED TYPE LASH ADJUSTER

[75] Inventor: Hisashi Kodama, Toyota, Japan

[73] Assignee: Aisin Seiki Kabushiki Kaisha, Kariya, Japan

[21] Appl. No.: 219,760

[22] Filed: Dec. 24, 1980

Related U.S. Application Data

[62] Division of Ser. No. 23,505, Mar. 23, 1979, Pat. No. 4,274,370.

[30] Foreign Application Priority Data

| | | | |
|---|---|---|---|
| Mar. 23, 1978 | [JP] | Japan | 53-37272 |
| Mar. 23, 1978 | [JP] | Japan | 53-37274 |
| Mar. 23, 1978 | [JP] | Japan | 53-37275 |

[51] Int. Cl.[3] ..... F01L 1/24

[52] U.S. Cl. ..... 123/90.58; 123/90.67; 123/90.46

[58] Field of Search ..... 123/90.28, 90.29, 90.46, 123/90.58, 90.67, 188 SC

[56] References Cited

U.S. PATENT DOCUMENTS

| | | | |
|---|---|---|---|
| 1,857,005 | 5/1932 | Schotthoefer | 123/90.67 |
| 2,165,239 | 7/1939 | Douglas et al. | 123/90.29 |
| 3,670,707 | 6/1972 | Guido | 123/90.58 |
| 3,941,102 | 3/1976 | Bareham | 123/90.67 |

*Primary Examiner*—Craig R. Feinberg
*Assistant Examiner*—W. R. Wolfe
*Attorney, Agent, or Firm*—Sughrue, Mion, Zinn, Macpeak & Seas

[57] ABSTRACT

A self-contained type lash adjuster is used in the valve train mechanism for internal combustion engines. The lash adjuster comprises an adjuster body having an axial hollow, a plunger body reciprocating within the axial hollow of the adjuster body, a reservoir chamber formed in the plunger body, a pressure chamber formed between the adjuster and plunger bodies, a check valve permitting an oil flow only in the direction from the reservoir chamber to the pressure chamber, a diaphragm positioned in the upper portion of the reservoir chamber, and a plunger return spring biasing the plunger body. The lash adjuster is supported in a recess in a valve spring retainer which is fixedly secured to the end of a valve stem.

1 Claim, 9 Drawing Figures

SELF-CONTAINED TYPE LASH ADJUSTER

CROSS-REFERENCE TO RELATED APPLICATION

The present application is a division of U.S. application Ser. No. 23,505, filed Mar. 23, 1979 now U.S. Pat. No. 4,274,370.

BACKGROUND OF THE INVENTION

1. Field of the Invention

This invention relates, in general, to lash adjusters for use in a valve train mechanism for internal combustion engines, and more particularly to a self-contained type lash adjuster which includes a supply of oil within the adjuster and which need not be supplied with oil from outside.

2. Description of the Prior Art

In general in internal combustion engines, valve clearance is formed in the valve train mechanism in order to compensate for the thermal expansion in the cylinder and the valve train and to stabilize the valve operation. As it is known, the lash adjuster operates to keep always the valve clearance in the zero state during valve operation and to stabilize the valve operation. The lash adjuster generally includes the problem that the mechanism supplying the oil from the oil pump to the inside of the lash adjuster is complicated. In order to solve such problem, a self-contained type lash adjuster has been proposed. However, in a conventional self-contained type lash adjuster there are drawbacks that the mechanism compensating the leak oil is imperfect, and complicated, and that the air is mixed in the oil during operation.

SUMMARY OF THE INVENTION

It is a principle object of the invention to provide a self-contained type lash adjuster which eliminates the drawbacks in the conventional lash adjuster.

It is another object of the invention to provide a self-contained type lash adjuster which is reliable in operation, is economical in manufacture and is compact in construction.

It is still another object of the invention to provide a self-contained type lash adjuster which is fitted in the valve train mechanism of overhead cam shaft (OHC) type.

Other objects, features and advantages of the invention will become more apparent upon reference to the succeeding detailed description thereof, and by reference to the drawings showing the preferred embodiments thereof.

DETAILED EXPLANATION OF THE INVENTION

Figure 1:
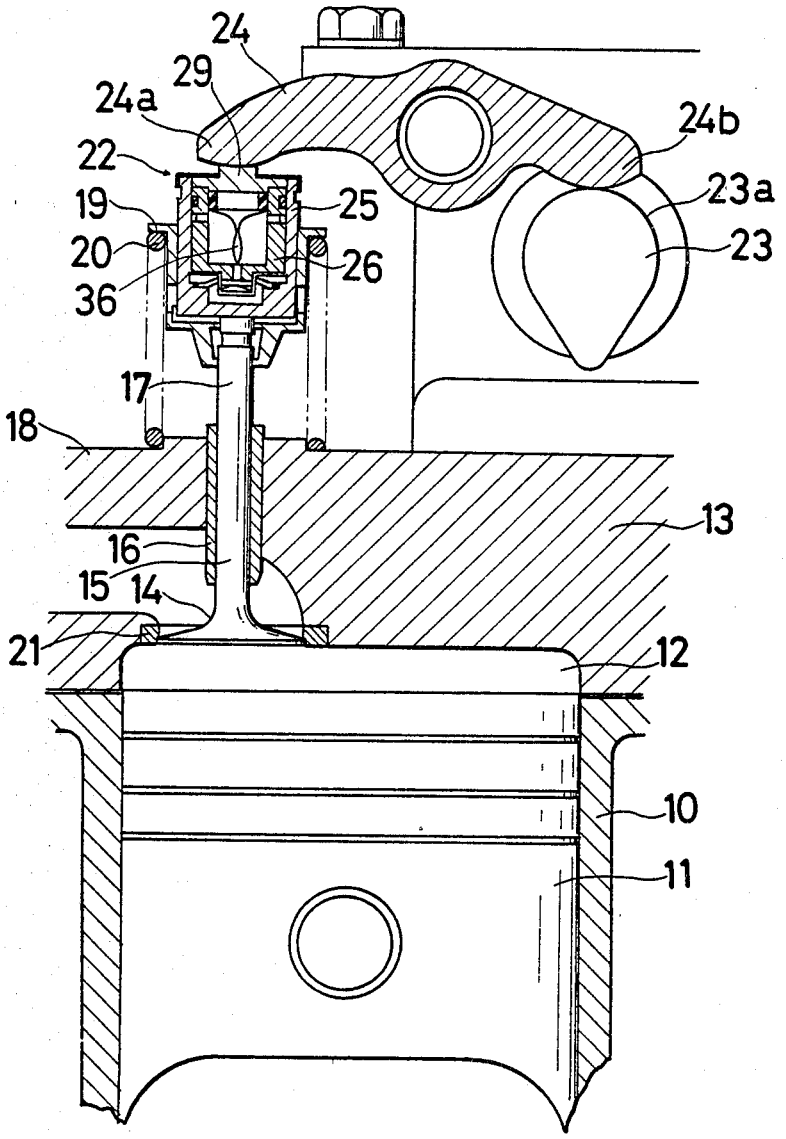
FIG. 1 is a sectional view of a valve train mechanism in an internal combustion engine incorporating the self-contained type lash adjuster in accordance with one illustrative embodiment of the present invention.

Referring now to FIG. 1, cylinder 10 contains a piston 11 which reciprocates within the cylinder 10. Above the piston 11 a combustion chamber 12 is formed by a cylinder head 13 forming the upper end portion of the cylinder 10. The communication between the combustion chamber 12 and a cylinder head port 14 may be controlled by an engine valve 15.

Securely fixed in the cylinder head 13 is a valve guide 16 through which a valve stem 17 is inserted. Located between a spring seat 18 at the upper end surface of the cylinder head 13 and a spring retainer 19 fixed securely on the valve stem 17 is a valve spring 20 which biases the valve 15 upwardly so that the valve 15 may be always in contact with a valve seat 21. Positioned between a self-contained type lash adjuster 22 and a cam shaft 23 is a rocker arm 24, one end 24*a* of which engages the upper end of the lash adjuster 22, the other end 24*a* of which is in contact with a cam surface 23*a* of the cam shaft 23. The rotational movement of the cam shaft 23 is transmitted to the valve 15 through the rocker arm 24, thereby operating the valve 15.

Figure 2:
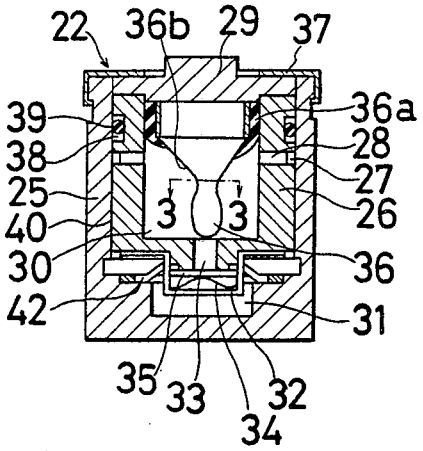
FIG. 2 is an enlarged sectional view of the lash adjuster.

Referring to FIG. 2, there is illustrated a cross-sectional view of the preferred embodiment of the lash adjuster 22. An adjuster body 25 engages slidingly in the axial hollow of the spring retainer 19. A plunger body 26 reciprocates within the axial hollow of the adjuster body 25. The plunger body 26 is provided with an annular groove 27 and passages 28 communicating with the groove 27. Closing the upper open end of the adjuster body 25 is a cap 29 whose upper end surface is in contact with the one end 24*a* of the rocker arm 24 and whose lower end engages in the upper open portion of the plunger body 26. Accordingly, the cap 29 can move axially in the axial hollow of the adjuster body 25 with the plunger body 26. The plunger body 26 is provided with a reservoir chamber 30 closed by the cap 29. In the bottom portion of the axial hollow of the adjuster body 25, a pressure chamber 31 is formed by the lower end surface. Inserted in the pressure chamber 31 is a spacer 32 acting as a stopper means. The plunger body 26 is provided with a passageway 33 in the bottom portion thereof. Normally biased by a spring 34 is a check valve 35 which permits an oil flow through the passageway 33 in a direction from the reservoir chamber 30 to the pressure chamber 31 and which prevents an oil flow in the reverse direction.

A diaphragm 36 including a stationary portion 36*a* and an elastic portion 36*b* is positioned in the upper portion of the reservoir chamber 30. The stationary portion 36*a* is inserted in the upper portion of the plunger body 26 and is supported by the lower end surface of the cap 29. The stationary portion 36*a* acts for sealing the oil in the reservoir chamber 30, while the elastic portion 36*b* acts for absorbing the changes in the oil volume in the reservoir chamber 30. The cap 29 is prevented from moving upwardly by a cover member 37. The plunger is provided with an annular groove 38 on the upper outer surface thereof. O-ring 39 inserted in the annular groove 38 forms the adjuster sealing portion, thereby sealing the oil such as silicone oil in the adjuster body 25. Formed between the inner surface of the adjuster body 25 and the outer surface of the plunger body 26 is a leak clearance 40 through which the leak oil flows from the pressure chamber 31 to the reservoir chamber 30.

Figure 3:
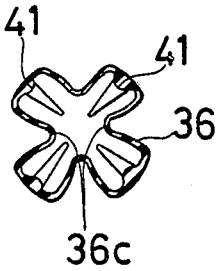
FIG. 3 is a sectional view taken along line 3—3 of FIG. 2.
Figure 4:
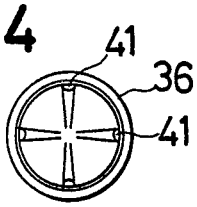
FIG. 4 is a plan view of the inside of the diaphragm of the lash adjuster of FIG. 2.
Figure 5:
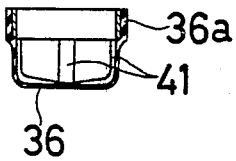
FIG. 5 is a sectional side elevation of FIG. 4.
Figure 6:
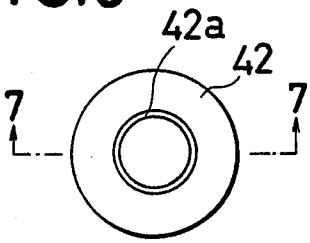
FIG. 6 is a plan view of the washer spring of the lash adjuster of FIG. 2.
Figure 7:
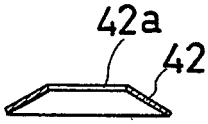
FIG. 7 is a sectional view taken along line 7—7 of FIG. 6.
Figure 8:
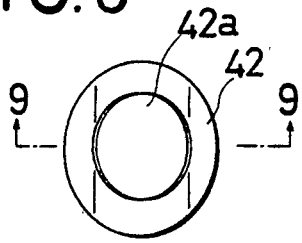
FIG. 8 is a plan view similar to FIG. 7 but showing another configuration.
Figure 9:
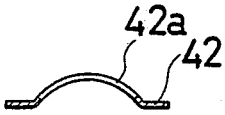
FIG. 9 is a sectional view taken along line 9—9 of FIG. 8.

The above mentioned diaphragm 36 is made of air impermeable elastic material such as rubber. As shown in FIGS. 3, 4 and 5, the diaphragm 36 is provided with dividing ribs 41 on the inside thereof, whereby each portion between two ribs may be movable elastically. Positioned between the adjuster body 25 and the plunger body 26 is a plunger return spring 42 biasing the plunger body 26 upwardly. As shown in FIGS. 6, 7, 8 and 9, the plunger return spring 42 consists of a washer spring. This washer spring 42 may be formed to be circular and to be provided with a hole 42*a* in the center thereof, as shown in FIGS. 6 and 7. Furthermore, this washer spring 42 may be formed to be elliptical as shown in FIGS. 8 and 9.

In operation, when the engine starts to operate, the cam shaft 23 begins to rotate by the crank shaft (not shown). Accordingly, since the end 24*b* of the rocker arm 24 is pushed up, the cap 29 is pushed down by the end 24*a* of the rocker arm 24. As a result, since the oil pressure in the pressure chamber 31 increases, the check valve 35 is maintained in the closed position. At this time, the oil in the pressure chamber 31 flows into the reservoir chamber 30 through the leak clearance 40, the annular groove 27, and the passages 28. Next, when the cam shaft 23 rotates further, the end 24*b* of the rocker arm 24 is pushed down following the cam surface 23*a* since the end 24*a* of the rocker arm 24 is biased upwardly by the spring 20. Accordingly, the plunger body 26 is pushed up against the adjuster body 25. As a result, since the oil pressure in the pressure chamber 31 decreases, the check valve 35 is maintained in the open position overcoming the pressure of the spring 34. At this time, since the oil in the reservoir chamber 30 flows into the pressure chamber 31 through the passageway 33, the length of the lash adjuster returns to the original length. In this way, the lash adjuster always repeats the expansion and contraction of a predetermined measure during operation. In this case, a portion 36*c* between two ribs 41 in the diaphragm 36 is crushed, as shown in FIG. 3, since the portion 36*c* is weak in stiffness.

What is claimed is:

1. In an internal combustion engine having at least one combustion chamber, a cylinder head having at least one port, a valve member having a stem guided in said head for controlling communication between said port and said chamber, cam operated means and spring means for reciprocating said valve means and self-contained hydraulic lash adjuster means interposed between said cam operated means and said valve means, the improvement comprising spring retainer means fixedly secured to the upper end of said stem, said spring retainer means having an upwardly opening axial bore slidably receiving said lash adjuster means therein and an outwardly directed flange on said spring retainer means for retaining said spring means between said retainer means and said head.

* * * * *